United States Patent [19]

Kondo

[11] Patent Number: 4,565,364

[45] Date of Patent: Jan. 21, 1986

[54] IMPLEMENT FOR MAGIC TRICK FOR FALSELY CUTTING CARD OR THE LIKE

[75] Inventor: Hiroshi Kondo, Tokyo, Japan

[73] Assignee: Tenyo Co., Ltd., Tokyo, Japan

[21] Appl. No.: 634,054

[22] Filed: Jul. 25, 1984

[30] Foreign Application Priority Data

Aug. 5, 1983 [JP] Japan ..... 58-121284[U]

[51] Int. Cl.[4] ..... A63J 21/00

[52] U.S. Cl. ..... 272/8 N

[58] Field of Search ..... 272/8 R, 8 N, 8 D, 27 N, 272/27 B; 70/289; 206/1.5; 273/148 R, 148 A, 153 R, 153 S, 155; 40/445; 446/489, 488, 147, 148, 149, 150, 151, 152

[56] References Cited

U.S. PATENT DOCUMENTS

| | | | |
|---|---|---|---|
| 1,061,576 | 5/1913 | Walter | 272/8 N |
| 1,762,501 | 6/1930 | Brehmer | 272/8 N |
| 2,127,412 | 8/1938 | Le Fevre | 272/8 N X |

FOREIGN PATENT DOCUMENTS

| | | | |
|---|---|---|---|
| 1309165 | 10/1962 | France | 446/147 |
| 233745 | 8/1925 | United Kingdom | 446/149 |

OTHER PUBLICATIONS

The Red Chinese Rabbit, Louis Tannen, Inc., No. 13, Catalog of Magic, p. 295.

Zig-Zag, Louis Tannen, Inc., No. 13, Catalog of Magic, p. 541.

About "Face", Louis Tannen, Inc., No. 13, Catalog of Magic, p. 474.

Zig Zag Cig., Abbott's Magic Co., Catalog No. 22, p. 80.

*Primary Examiner*—Robert A. Hafer

*Assistant Examiner*—Arnold W. Kramer

*Attorney, Agent, or Firm*—Murray, Whisenhunt and Ferguson

[57] ABSTRACT

A magic trick for falsely cutting a playing card has first and second sections each with a top layer, a bottom layer, and an intermediate layer, with the top layer of the first section having three windows and the intermediate layer of the second section having an opening corresponding in size to the middle window. The inner sided of the sections are pivoted together so that on folding the two top sides of the sections abut. A lower opening extends between the lower compartments when the body is unfolded and continues out through the outer side of the first section, and an upper opening extends between the upper compartments. A flexible rectangular element is folded half way back on itself with the free edge of the folded portion lying in the upper opening, and with the unfolded lower portion extending through the lower opening iwth the free edge in the opening in the outer side of the first section with card indicia on the exposed upper face of the lower portion. On insertion of a playing card through an opening in the end of the first section into the upper compartment below the windows and then pulling on the element it appears that a section of card is cut and pulled aside and on then pushing on the element it appears that the card has been restored.

6 Claims, 7 Drawing Figures

IMPLEMENT FOR MAGIC TRICK FOR FALSELY CUTTING CARD OR THE LIKE

BACKGROUND OF THE INVENTION

The present invention relates to an implement for a magic trick and, more particularly, to an implement for a magic trick for falsely cutting a card or the like such as playing cards.

SUMMARY OF THE INVENTION

The present invention contemplates to provide a magic trick in which a card or the like of playing cards is inserted into a vessel and even if a part of the card within the vessel is cut, the card can be removed in the original state from the vessel.

The present invention provides an implement for doing a magic trick for falsely cutting a card or the like of playing cards which comprises front and rear walls disposed oppositely to each other and forming a space to receive the card, a plurality of windows formed at the front wall for partly exposing the surface of the card and a curtain associated therein so as to have a first false display substantially the same as the state of the part of the surface of the card exposed from at least one of the windows and a second false display substantially the same as the state of the rear wall corresponding to at least one of the windows in a manner adjacent to the first false display in such a manner that the first and second false displays are generally concealed therein and the second false display is disposed in at least one of the windows when the first false display is externally disposed.

The above and other objects of the invention will be apparent by those skilled in the art from a reading of the following detailed description of the disclosure found in the accompanying drawings and novelty thereof pointed out in the appended claims.

DETAILED DESCRIPTION OF THE PREFERRED EMBODIMENTS

Embodiments of the present invention will now be described in more detail with reference to the accompanying drawings.

Figure 1:
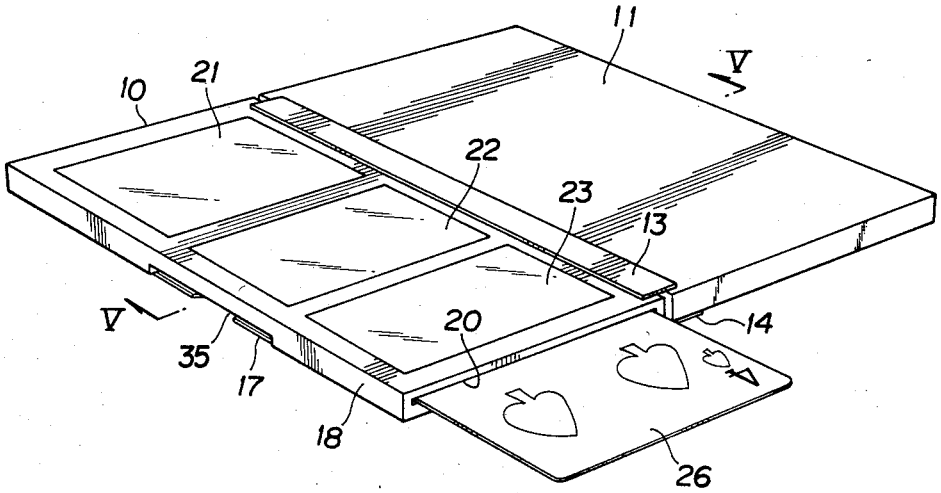
FIG. 1 is a perspective view showing an embodiment of an implement for a magic trick according to the present invention.

An implement for a magic trick of the invention comprises a body having two sections 10 and 11 formed in a thin rectangular box shape, as shown in FIG. 1. The opposed sides of the both sections 10 and 11 are coupled by hinge members 13 and 14 so that the both sections 10 and 11 are pivotally moved to each other at the hinge members 13 and 14 as a center.

Figure 2:
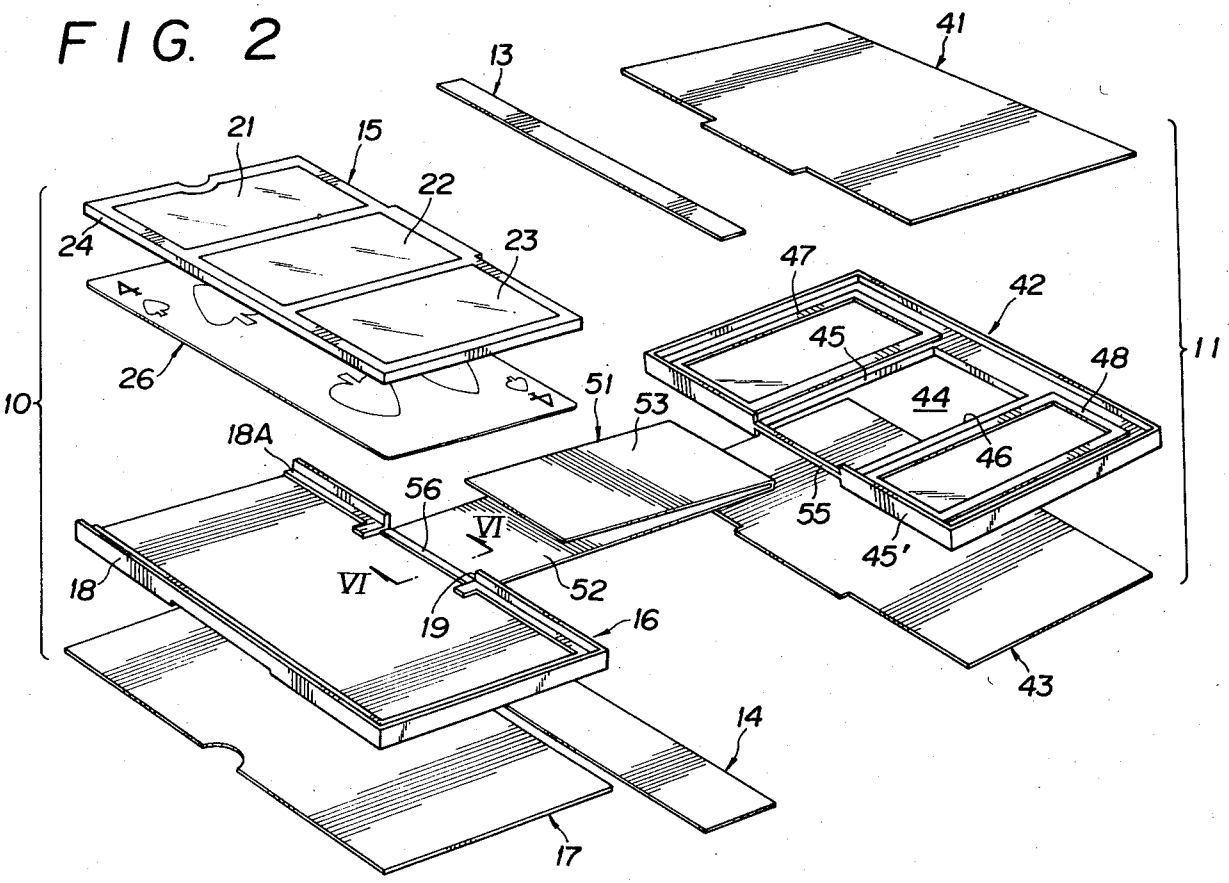
FIG. 2 is an exploded perspective view of the implement of the invention.

The section 10 comprises, as shown in FIG. 2, a front wall 15 and a rear wall 16. The rear wall 16 has three side edge walls 18 extending perpendicularly to the plane of the rear wall 16 at both sides toward the frontward and rearward directions except one side. One of the side edge walls 18 opposed to the section 11 has a notch 19. A projecting strip 18A which is lower in height than the side walls 18 is formed on the inside of the side edge walls 18. The front wall 15 is disposed inside the side edge walls and bonded to the projecting strips 18A to form a space between the front wall 15 and the rear wall 16. This space is opened at the side having no side edge wall of the rear wall 16 and at the notch 19 with the external environment. The only opened part of the space at the side having no side edge wall is designated by reference numeral 20 in FIG. 1.

The front wall 15 has a plurality of (e.g., three) windows 21, 22 and 23, which are equal in size and aligned longitudinally in the section 10. The windows are formed, for example, by composing the front wall 15 itself of a transparent plate and window frames of the windows 21, 22 and 23 of paint coated on the transparent plate or punching the respective windows 21, 22 and 23 at a sheet or film laminated to the transparent plate.

A card 26 is, for example, "4" of a spade of playing cards known per se, and is inserted into the space between the front wall 15 and the rear wall 16 through the opening 20 of the section 10. The card is concealed by the window frame at the peripheral edges in this state, and the dimensions of the section 10 are determined in such a manner that the numerals "4" and the marks of the spade are exposed from the windows 21 and 23.

Figure 3:
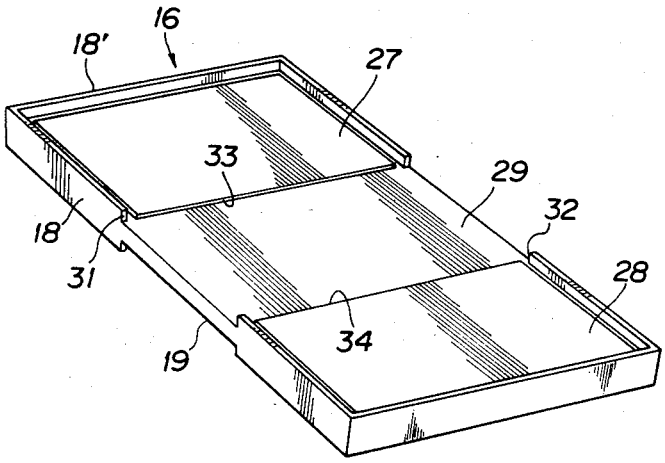
FIG. 3 is a perspective view of the back surface of the rear wall of the implement.
Figure 5:
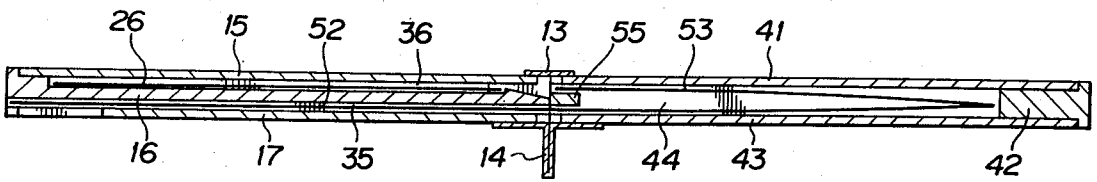
FIG. 5 is a sectional view of the implement taken along the line V—V in FIG. 1.

On the other hand, the rear wall 16 has on the back surface side, as shown in FIG. 3, side edge walls 18 extending from the side edge walls of the front surface side, and also has a side edge wall 18' at the side where the rear wall 16 does not have the side edge wall at the corresponding side. These side edge walls 18 also have projecting strips 27 and 28 inside the side edge walls 18. The rear wall 16 has a rectangular recess 29 formed at the intermediate portion. The recess portion 29 is so formed that the opposed inner walls 33 and 34 are disposed between the window 22 and 21, 23 of the front wall 15, respectively. The side edge walls 18 are cut out at notches 31 and 32 having a length corresponding to the length between the opposed inner walls 33 and 34 of the recess portion 29 at both side ends of the recess portion 29. Other wall 17 is formed as part of the rear wall 16, and is disposed within the space formed around the side edge walls 18 and the side edge wall 18' and bonded to the projecting strips 27 and 28 to form a tunnel with the notches 31, 32 and the recess 29. This tunnel is designated by reference numeral 35 in FIG. 5, and another tunnel formed at opposite side of the front wall 15 and the rear wall 16 is designated by reference numeral 36.

Referring back to FIG. 2, the section 11 is composed of a front wall 41, a rear wall 43 and an intermediate wall 42. The intermediate wall 42 is disposed at the center between the front wall 41 and the rear wall 43, and has an opening 44 opened at the side faced with the section 10. This opening 44 is disposed at the position corresponding to the recess 29 of the rear wall 16 of the section 10 and has opposed inner side walls 45 and 46 formed at the interval equal to the interval between the inner walls 33 and 34 of the recess portion 29 of the section 10. The side wall 45' is formed at the peripheral edges of the intermediate wall 42 except the opening 44. The side wall 45 is also extended to the back surface of the rear wall 42. Projection strips 47 and 48 are formed along the side wall 45' and the opening 44 which are formed lower in height than the side wall 45'. The front wall 41 is disposed within the space formed around the side wall 45', and bonded to the projecting strips 47 and 48. The rear wall 43 is disposed within the side walls 45', bonded to the back surface of the intermediate wall, and the space opened at the side facing the section 10 is formed at the opening 44. The depth of the opposed inner walls 45 and 46 of the opening 44 is substantially equal to the distance between the front wall 15 and the rear wall 17 of the section 10, and the space formed by the opening 44 is connected to the tunnels 35 and 36 of the section 10.

Figure 4:
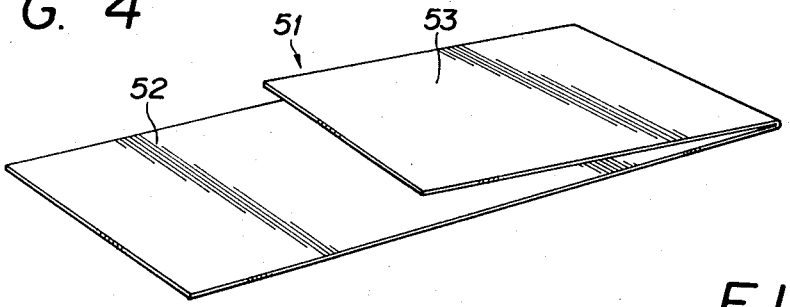
FIG. 4 is a perspective view of a curtain of the implement.

A curtain 51 is formed of paper of strip shape having a width slightly narrower than the interval between the inner walls 33 and 34 of the recess portion 29 and between the inner side walls 45 and 46 of the opening 44. This curtain 51 has, as shown in FIG. 4, a first false display 52 at one end and a second false display 53 on the opposite surface of the other end. The first false display 52 is printed with the same state as the card 26 exposed from the intermediate window 22 of the section 10, i.e., substantially with the same state as the background of the central portion of the card, while the second false display 53 is printed with the state of the rear wall 16 exposed from the window 22 when no card 26 is existed, e.g., with a mat black. This curtain 51 is bent at the end of the second false display 53 at 180° so as to be contained in the body so that, as better shown in FIG. 5, the first false display 52 is disposed in the tunnel 35 between the walls 16 and 17 forming the rear wall of the section 10, i.e., in the recess portion 29, and the second false display 53 is disposed in the opening 44 of the section 11 together with the other section. The curtain 51 is operated so that when the first false display 52 is pulled out of the tunnel 35 of the section 10, the second false display 53 is moved to the position corresponding to the space between the front wall 15 and the rear wall 16 of the section 10 under the window 22, and when the second false display 53 is concealed in the section 11 then the first false display 52 is disposed in tunnel 35.

Figure 6:
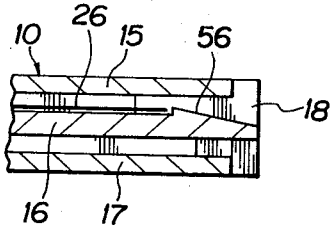
FIG. 6 is a sectional view of part of the rear wall of the implement taken along the line VI—VI in FIG. 2.

In order that the second false display 53 of the curtain 51 is reliably inserted into the tunnel 35 of the section 10 through the opening formed at the notch 19, a guide member 55 disposed to cross the opening 44 is provided at the opening end side of the opening 44 in the rear wall 42 of the section 11 so that the guide member 55 is disposed between the two portions of the card folded in U shape. Thus, the second false display 53 of the curtain 51 may be reliably inserted into the tunnel 35 of the section 10 through the notch 19. Further, as shown in FIG. 6, a guide 56 inclined toward the opening end side of the opening 44 of the section 11 toward the outside is provided in the notch 19 of the rear wall 16 of the section 10. This guide 56 is operated to deflect the curtain 51 toward the upper surface of the card 26 when the curtain 51 is introduced into the tunnel 35, and to position the card 26 at the end of the widthwise side of the card 26.

Figure 7:
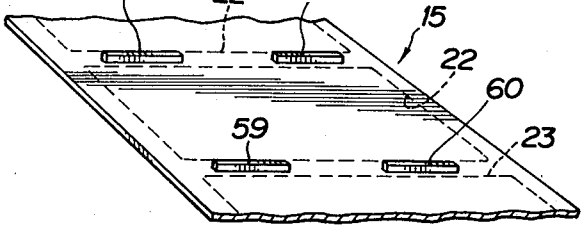
FIG. 7 is a perspective view showing the back surface of the part of the front wall of the implement in another embodiment of an implement for a magic trick according to the invention.

The card and the curtain thus disposed can be separated by providing a small projection along the window frame on the inner surface of the front wall of the section 10 along the window frames between the windows 21, 23 and the window adjacent thereto. FIG. 7 shows the means for separating the card from the curtain. The separating means has guides 57 to 60 disposed at the window frames between the windows 21 and 22 and 23 on the extension of the side walls 45 and 46 of the opening 44 of the section 11. When the curtain 51 is inserted into the section 10, the inserted part of the curtain 51 is guided to be moved straightly by the guides 57 to 60, and the card in the section 10 is pressed by the rear wall 16 at the ends of the guides 57 to 60 to be fixed at the position.

The hinge member 13 is disposed to cross between the front wall 15 of the section 10 and the front wall 41 of the section 11, and bonded thereto. Another hinge member 14 is disposed to cross between the rear walls 17 and 43 of the sections 10 and 11, respectively, and bonded thereto. The hinge member 13 is, for example, formed of a flexible synthetic resin sheet or film. However, the hinge member 14 is, for example, formed of a thin hard synthetic resin plate with folding lines. The sections 10 and 11 are formed to be pivotally moved at the hinge members as a center so that the front walls 15 and 41 may be superposed to each other.

A magic trick can be, for example, played effectively as follows:

A magic trick is started from the state that the card 26 is first inserted into the space between the front wall 15 and the rear wall 16 of the section 10 of the body of the implement and the sections 10 and 11 are folded. Then, before guests, the sections 10 and 11 of the body are opened, and the section 10 is held by a left hand by a magician. The magician then allows the guests to satisfactorily watch the front and back surfaces of the card 26 by pulling the card 26 from the opening 20 of the body. Then, the card 26 is inserted into the space between the front wall and the rear wall of the section 10 of the body from the opening 20. The lower part of the body is held by a right hand over the sections 10 and 11, and the sections 10 and 11 are fully opened so that the sections 10 and 11 lie in the same plane. Then, the end of the curtain 51 is pulled out from the opening 36 of the body by the forefinger or index finger of the left hand. Thus, the first false display 52 which is the same as the portion seen from the window 22 of the card 26 is pulled out of the body, and the first false display 53 of the curtain 51 is introduced between the front wall 15 and the card 26 of the body to be exposed in the window 22. Then, the guests understand thereby that the card 26 is impressed to be cut into three portions. Thereafter, when the curtain 51 is returned into the body, the first false display 52 of the curtain 51 is introduced into the space between the rear wall 16 and the wall 17, the second false display 53 is inserted into the notch 44 of the section 11, only the card 26 is thus permitted to remain in the space between the front wall 15 and the rear wall 16 of the section 10, and is seen from the window 22 by the guests. Therefore, the guests are impressed that the cards cut into the three portions can be returned to the original integrated state. Then, when the curtain 51 is fully inserted into the body and contained completely in the body, and the card 26 is pulled out from the body by the left hand. Then, the sections of the body are closed to finish the magic trick.

Since the curtain 51 is guided by the inner walls 45 and 46 of the opening 44 of the section 11 when the curtain 51 is moved, the second false display 53 is accurately guided into the space between the front wall 15 and the rear wall 16 of the section 10 under the guidance of the guide 55 and the card 26 is pressed to the rear wall 16 by the guides 57 to 60 in this magic trick according to the present invention, the second false display of the curtain is reliably inserted at the end into the small space between the card 26 and the front wall 15. Since the edges of the second false dispay of the curtain are further concealed by the window frames between the window 22 of the front wall 15 and the adjacent windows 21, 23, the guests are impressed so that the card 26 is cut at the center relating to the window 22 though the second false display 53 is actually moved on the card 26.

What is claimed is:

1. An implement for a magic trick for falsely cutting a card or the like, comprising:

a card having a front and a back, said front having first indicia thereon and said back having second indicia thereon;

a body comprising a first section and a second section, each said section being substantially rectangular and having a predetermined length and a predetermined width; said first and second sections being of substantially equal length and substantially equal width;

said first section comprising a transparent front wall, a first opaque wall, a second opaque wall and a pair of opposed side edge walls, said transparent front wall, said first opaque wall and said second opaque wall connected to said pair of opposed side edge walls so that said transparent front wall, said first opaque wall and said second opaque wall are arranged sequentially one above the other to form spaces therebetween, said transparent front wall, said first opaque wall, and said pair of opposed side edge walls defining a space receivable of said card, said transparent front wall being divided into a plurality of windows, each window having a predetermined length and extending across substantially the entire width of said first section; a first slit formed through one of said pair of opposed side edge walls, said first slit having a length substantially equal to the length of one of said plurality of windows and aligned with said one window, said first slit communicating with said space between said transparent front wall and said first opaque wall; a second slit formed through said one of said pair of opposed side edge walls, said second slit having a length substantially equal to the length of said first slit and aligned with said first slit, said second slit communicaticating with said space between said first opaque wall and said second opaque wall; a third slit formed through the other of said pair of opposed side edge walls, said third slit having a length substantially equal to the length of said second slit and aligned with said second slit, said third slit communicating with said space between said first opaque wall and said second opaque wall;

said second section comprising a front wall, an intermediate wall and a bottom wall and a pair of opposed side walls, said front wall, said intermediate wall and said bottom wall connected to said pair of opposed side walls so that said front wall, said intermediate wall and said bottom wall are arranged sequentially one above the other to form spaces therebetween, said first section and said second section disposed in alignment with one another and having said one of said pair of opposed side edge walls of said first section adjacent one of said pair of opposed side walls of said second section; said intermediate wall having an opening therein having a length substantially equal to the length of said one of said plurality of windows and aligned with said one window, said opening having a width substantially equal to the width of said second section; a fourth slit formed through said one of said pair of opposed side walls, said fourth slit having a length substantially equal to the length of said opening and aligned therewith, said fourth slit communicating with said opening at a position between said front and said intermediate walls; a fifth slit formed through said one of said pair of opposed side walls, said fifth slit having a length substantially equal to the length of said opening and aligned therewith, said fifth slit communicating with said opening at a position between said intermediate and said bottom walls; said fourth and fifth slits aligned with said first and second slits, respectively; and a covering member, slidably received within said first through fifth slits, said covering member having a length substantially equal to the length of said one of said plurality of windows and a width substantially equal to three times the width of said one of said plurality of windows, said covering member comprising a first false display portion, a second false display portion and a connecting portion intermediate said first and second false display portions, said first portion, said second portion and said connecting portion being of substantially equal widths with said second portion folded back upon said connection portion, the free end of said first false display portion disposed proximate said third slit and the free end of said second false display portion proximate said first slit, whereby by pulling the free end of said first portion the second portion slides over that portion of a card displayed through said one of said plurality of windows.

2. The implement according to claim 1, wherein said plurality of windows comprises three windows and said first slit us aligned with the central window.

3. The implement according to claim 1, wherein said first section and said second section are pivotally connected to one another along said adjacent walls.

4. The implement according to claim 1, wherein said card is a playing card having the numeral 2 or 4, and the first slit is aligned with a portion of the card having no marking or numeral thereon.

5. The implement according to claim 1, wherein said transparent front wall has at least one projecting strip means, disposed widthwise thereacross, for pressing said card against said first opaque wall.

6. The implement according to claim 1, wherein said plurality of windows are formed by a window frame painted on said transparent front wall.

* * * * *